United States Patent [19]

Oliff

[11] Patent Number: 4,577,799

[45] Date of Patent: Mar. 25, 1986

[54] PANEL INTERLOCKING MEANS

[75] Inventor: James R. Oliff, Austell, Ga.

[73] Assignee: The Mead Corporation, Dayton, Ohio

[21] Appl. No.: 695,184

[22] Filed: Jan. 28, 1985

[51] Int. Cl.[4] ..... B65D 5/08

[52] U.S. Cl. ..... 229/40; 206/427; 229/48 R

[58] Field of Search ..... 229/40, 48 R; 206/427, 206/434, 140–165

[56] References Cited

U.S. PATENT DOCUMENTS

| | | | |
|---|---|---|---|
| 3,367,557 | 2/1968 | Farguhar | 229/40 |
| 3,797,729 | 3/1974 | Holmes | 229/40 |
| 3,827,550 | 8/1974 | Arneson | 229/39 R |
| 3,955,748 | 5/1976 | Calvert | 229/44 R |
| 4,093,116 | 6/1978 | Watkins et al. | 229/40 |
| 4,215,781 | 8/1980 | Humphries et al. | 229/40 |

FOREIGN PATENT DOCUMENTS

| | | | |
|---|---|---|---|
| 3935 | 9/1979 | European Pat. Off. | 229/40 |

*Primary Examiner*—Steven M. Pollard
*Assistant Examiner*—Gary E. Elkins
*Attorney, Agent, or Firm*—Rodgers & Rodgers

[57] ABSTRACT

An article carrier having top lap panels, bottom and side walls interconnected to form a tubular structure is provided with end closure means in the form of end panels hinged to each end edge of each side wall, the panels being folded into overlapping relationship and being secured together by interlocking means which comprise at least one locking aperture formed in one end panel at each end of the carrier and arranged to cooperate with a corresponding locking tab foldably joined to the other end panel at each end of the carrier and having an integral locking toe and an integral locking heel extending in opposite directions, the locking heel and locking toe being arranged to be inserted into the locking aperture, and a holding tab formed integrally with the panel in which the locking aperture is formed and projecting inwardly into the locking aperture so as to engage the toe of the locking aperture thereby to aid in holding the locking tab in interlocked relationship with the locking aperture.

4 Claims, 6 Drawing Figures

PANEL INTERLOCKING MEANS

TECHNICAL FIELD

This invention relates to article carriers having top lap panels, bottom and side walls interconnected to form a tubular structure wherein end panels are hinged to each end edge of each side wall and wherein such panels are interlocked by locking apertures and cooperating locking tabs of the so-called heel and toe type.

BACKGROUND ART

U.S. Pat. No. 3,955,748 issued May 11, 1976 and owned by the assignee of this invention discloses an article carrier of the type to which this invention is applicable and with respect to which this invention constitutes an improvement.

DISCLOSURE OF THE INVENTION

According to this invention in one form, interlocking means for securing two panels together in overlapping relation is provided and comprises a locking tab foldably joined to one panel and including a locking toe and a locking heel integral with the locking tab, a locking aperture formed in the other panel and having a locking edge for engaging the locking heel togetherwith a holding tab formed integrally with the panel in which the locking aperture is formed and which projects inwardly into said locking aperture from a position opposite the locking edge thereof for engaging the outer surface of the extremity of said locking toe thereby to aid in holding said locking toe in locked condition.

BRIEF DESCRIPTION OF THE DRAWINGS

In the drawings,

FIG. 5 is an enlarged view of panel interlocking means formed according to this invention and in which

BEST MODE OF CARRYING OUT THE INVENTION

Figure 1:
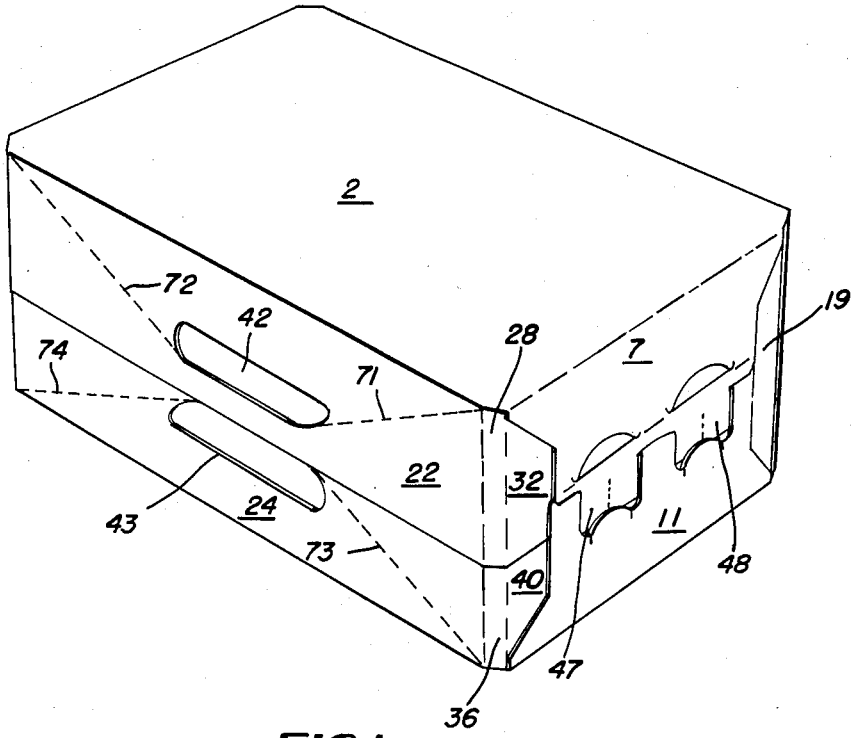
FIG. 1 is a perspective view of an article carrier having end panel closure means formed according to this invention.

In the drawings the numeral 1 designates the bottom wall of the carrier. Side wall 2 is foldably joined to bottom wall 1 along fold line 3 and side wall 4 is foldably joined to bottom wall 1 along fold line 5. End wall panels 6 and 7 are respectively joined to side wall 2 along fold lines 8 and 9. Similarly end wall panels 10 and 11 are foldably joined respectively to side wall 4 along fold lines 12 and 13. Bevelled panels 14 and 15 are joined respectively to bottom wall 1 along fold lines 16 and 17. End closure flaps 18 and 19 are foldably joined to bevelled panels 14 and 15 respectively along fold lines 20 and 21.

Top lap panel 22 is foldably joined to side wall 2 along fold line 23 while top lap panel 24 is foldably joined to the side wall 4 along fold line 25. Bevelled panel 26 is foldably joined to top lap panel 22 along fold line 27 while bevelled panel 28 is foldably joined to top panel 22 along fold line 29. End flap 30 is foldably joined to bevelled panel 26 along fold line 31 while end flap 32 is foldably joined to bevelled panel 28 along fold line 33.

At the other end of the carrier bevelled panel 34 is foldably joined to top lap panel 24 along fold line 35 while bevelled panel 36 is foldably joined along fold line 37 to top lap panel 24. End flap 38 is foldably joined to bevelled panel 34 along fold line 39 while end flap 40 is foldably joined to bevelled panel 36 along fold line 41.

Hand carrying apertures 42 and 43 are formed in top lap panels 22 and 24 respectively.

Locking tabs 44 and 45 are foldably joined to end wall panel 10 along fold line 46 and locking tabs 47 and 48 are foldably joined to end panel 11 along fold line 49. Weakened longitudinal lines 50 and 51 are formed in locking tabs 44 and 45 respectively while similar longitudinal weakened fold lines 52 and 53 are formed in locking tabs 47 and 48 respectively to facilitate longitudinal folding of the locking tabs.

Locking apertures 54 and 55 are formed in end panel 6 while similar locking apertures 56 and 57 are formed in end panel 7. Locking apertures 54–57 include locking edges 58-61 respectively.

In order to facilitate unloading the carton, a conventional pull tab 68 and associated tear lines 69 and 70 may be formed in bottom wall 1 and in a side wall such as 4.

Yieldable lines such as 71 and 72 may be formed in lap panel 22 and similar lines 73 and 74 may be formed in panel 24.

Figure 2:
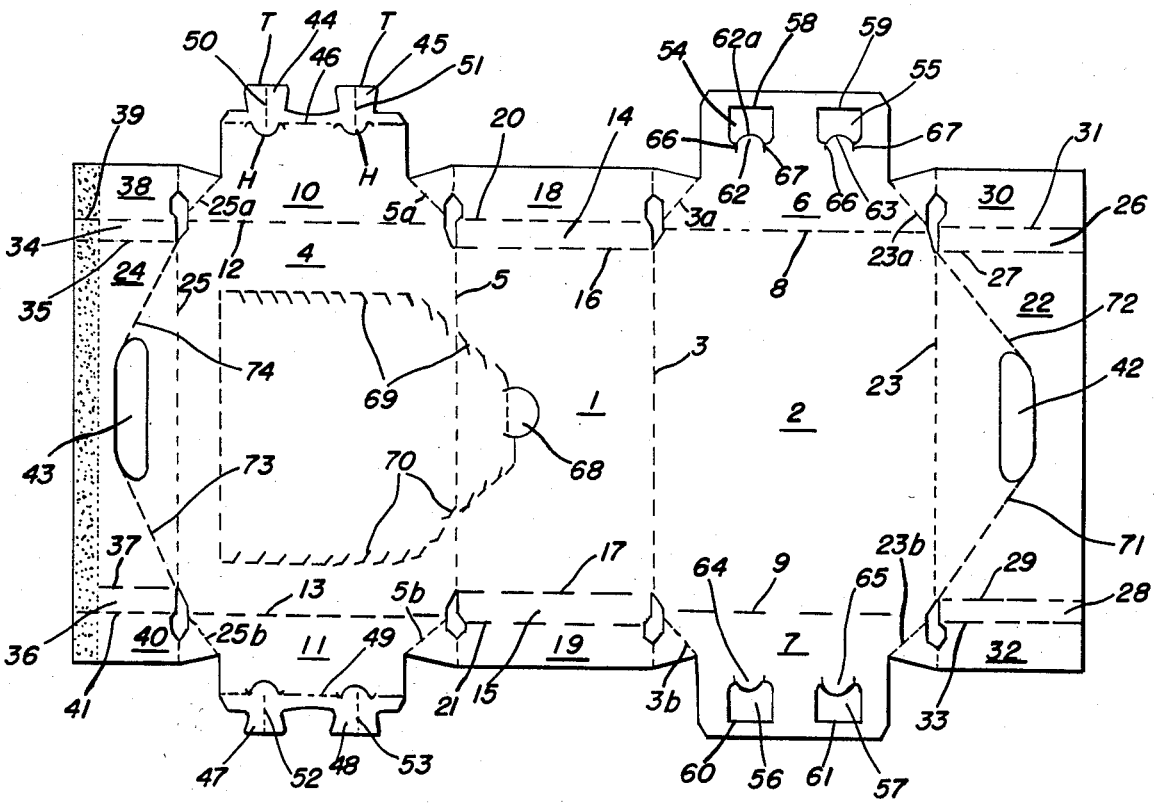
FIG. 2 is a plan view of the inner surface of a blank from which the carrier shown in FIG. 1 is formed.
Figure 3:
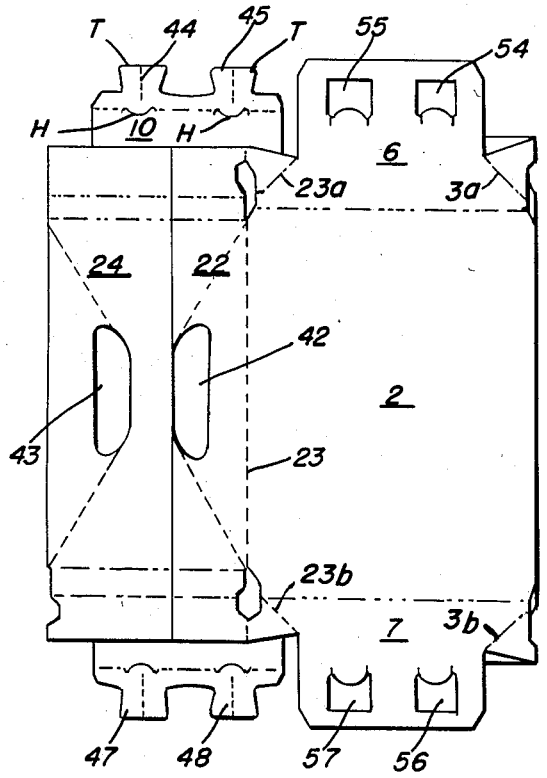
FIG. 3 depicts a completed carrier in collapsed condition.
Figure 4:
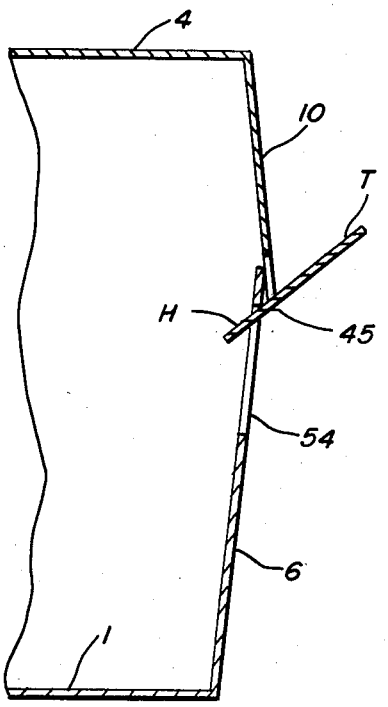
FIG. 4 is an enlarged cross-sectional view depicting an intermediate stage in the formation of panel interlocking means according to this invention.

In order to form the carrier in collapsed form as shown in FIG. 3 from the blank as shown in FIG. 2, an application of glue is made to top lap panel 24 to bevelled panels 34 and 36 and to end flaps 38 and 40 as indicated by stippling in FIG. 2. Thereafter side wall 2 and top lap panel 22 together with all of the flaps associated with these elements are folded upwardly and toward the left along fold line 3 into positions overlying bottom wall 1 and side wall 4. Thereafter top lap panel 24 is folded to the right and upwardly along fold line 25 into overlapping relation with respect to top lap panel 22. Of course this operation secures the top lap panels together and the carton then appears as shown in FIG. 3.

Figure 5:
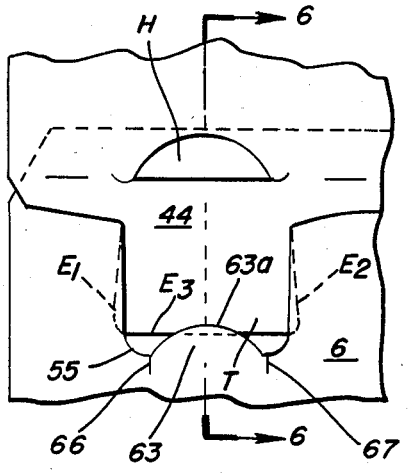
Figure 6:
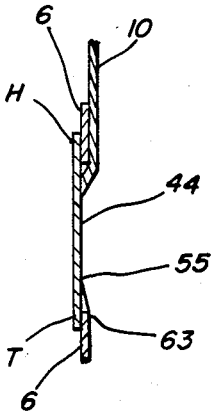
FIG. 6 is a cross-sectional view of panel interlocking means taken along the line designated 6-6 in FIG. 5.

In order to load the carton, it is first manipulated from its collapsed conditions as represented in FIG. 3 to an open ended tubular condition. Thereafter articles to be packaged are inserted through the open ends of the carton and the end flaps associated with bottom wall 1 and with lap panels 22 and 24 are closed. This operation swings the webs defined by fold lines 25, **25*a* and 5, 5*a* inside the end panel 10 and also folds the webs 25, 25*b* and 5, 5*b* inside the end panel 11 while webs 3, 3*a* and 23,23*a* are similarly folded inside end panel 6 and webs 3, 3*b* and 23,23*b* are folded inside end panel 7. Thereafter end panels 10, 6, 11 and 7 are folded inwardly and into overlapping relation and the locking tabs are than manipulated into locked condition with respect to their associated locking apertures. For example, locking tab 44 is manipulated so that its heel H enters locking aperture 55 and thereafter the toe T of locking tab 44 is manipulated through the locking aperture 55 with its side edge portions disposed inside and in overlapping relation with respect to the side edges of aperture 55 as best shown in FIG. 5**.

The above described locking arrangement is sometimes subject to misalignment of the heel which in turn results in engagement of the toe on only one side edge such as E1 while the opposite side edge E2 does not enter the associated locking aperture.

In order to aid in holding the locking tabs such as 44 in locked position particularly when one edge such as E2 does not enter the locking aperture, holding tab such as 63 is provided according to this invention and overlies the end edge E3 of locking tab 44 and thus aids in holding the locking tab in locked condition by insuring that the locking tab is engaged at two points, i.e., E1 and E3. When locked the inner surface of holding tab 63 is in engagement with the outer surface of the end portion E3 of locking tab 44. Of course during insertion of the toe portion T of locking tab 44 through the locking aperture 55, the inner surface of the locking toe T engages the outer surface of holding tab 63 and swings the holding tab inwardly until the end edge E3 of locking tab 44 clears and moves behind the holding tab 63. Holding tabs 62, 64 and 65 are identical in structure and function to holding tab 63.

In order to facilitate manipulation of the holding tab such as 63 a pair of slits 66 and 67 are formed in panel 6 on opposite sides of holding tab 63.

The inwardly projecting end portion of each of the holding tabs such as 63 is of arcuate configuration as is apparent at 63*a* as best shown in FIG. 5, thus to facilitate cooperation with the associated locking tab such as 44.

From the above description and from the drawings it is apparent that according to a feature of this invention the end edge E3 of locking tab 44 is secured in its locked position by the arcuate end portion 63*a* of holding tab 63 so that at least two points of engagement of the locking tab are provided even though one edge fails to enter the associated locking aperture. Furthermore, as is apparent from FIG. 5 the holding tab 63 serves to overlie and partially to close that portion of locking aperture 55 which is immediately adjacent the inner ends of the slits 66 and 67. This closure action of holding tab 63 not only improves the appearance of the lock, it also tends to prevent possible inadvertent use of locking apertures such as 55 as finger receiving carrying apertures. Of course holding tabs such as 63 effectively prevent such improper use of the carrier.

INDUSTRIAL APPLICABILITY

According to this invention, security of heel and toe type locking tabs with respect to their associated locking apertures is substantially enhanced and the appearance and general serviceability of the carton is improved.

I claim:

1. Interlocking means for securing two end wall panels of a carton together in overlapping relation, said interlocking means comprising a locking tab joined to one of the panels along a first fold line and having an integral locking toe and an integral locking heel extending in opposite directions from said first fold line and generally transverse thereto, weakened fold line formed in said locking tab generally transverse to said first fold line, a locking aperture formed in the other panel and having a locking edge for engaging said locking heel upon insertion of said locking heel into said locking aperture in coordination with folding of said locking tab along said first fold line out of the plane of said one panel and relative movement of the panels toward each other, and said locking toe being of a size and configuration such that said locking toe is wider than the width of said aperture so that swinging movement of said locking tab causes at least one side edge portion of said locking toe to overlap a corresponding part of said other panel and so as to fold said locking tab along said weakened fold line, and a holding tab formed integrally with said other panel and disposed opposite said locking edge and having an arcuate end portion projecting inwardly into said locking aperture for engaging the outer surface of the extremity of said locking tab in flat face contacting relation thereby to aid in holding said locking tab in locked condition.

2. Interlocking means according to claim 1 wherein the inner surface of said locking tab initially engages the outer surface of said holding tab and swings said holding tab out of the plane of said other panel and allows the inner surfae of said holding tab to engage the outer surface of said locking tab.

3. Interlocking means according to claim 1 wherein a pair of slits are formed in said other panel and disposed on opposite sides of said holding tab.

4. Interlocking means according to claim 3 wherein the inner ends of said slits are in coincidence with the edge of said locking aperture.

* * * * *